US010989008B2

(12) United States Patent
Kaster

(10) Patent No.: US 10,989,008 B2
(45) Date of Patent: Apr. 27, 2021

(54) CAP FOR A HYDROCARBON PRODUCTION WELL AND METHOD OF USE

(71) Applicant: Total E&P Danmark A/S, Copenhagen (DK)

(72) Inventor: Martin Kaster, Frederiksberg C (DK)

( * ) Notice: Subject to any disclaimer, the term of this patent is extended or adjusted under 35 U.S.C. 154(b) by 26 days.

(21) Appl. No.: 16/463,779

(22) PCT Filed: Nov. 13, 2017

(86) PCT No.: PCT/EP2017/079025
§ 371 (c)(1),
(2) Date: May 23, 2019

(87) PCT Pub. No.: WO2018/095752
PCT Pub. Date: May 31, 2018

(65) Prior Publication Data

US 2019/0376358 A1 Dec. 12, 2019

(30) Foreign Application Priority Data

Nov. 24, 2016 (GB) ..... 1619855

(51) Int. Cl.

| | |
|---|---|
| ***E21B 33/037*** | (2006.01) |
| ***E21B 29/00*** | (2006.01) |
| ***E21B 33/12*** | (2006.01) |
| ***E21B 33/03*** | (2006.01) |

(52) U.S. Cl.
CPC ..... *E21B 33/037* (2013.01); *E21B 29/00* (2013.01); *E21B 33/03* (2013.01); *E21B 33/12* (2013.01)

(58) Field of Classification Search
CPC ..... E21B 33/037; E21B 33/03; E21B 33/04; E21B 33/038; E21B 33/035; E21B 33/0355; E21B 29/00; E21B 33/12; E21B 34/02; E21B 43/10
See application file for complete search history.

(56) References Cited

U.S. PATENT DOCUMENTS

| | | | |
|---|---|---|---|
| 4,804,045 | A | 2/1989 | Reed |
| 5,107,931 | A | 4/1992 | Valka et al. |
| 7,013,970 | B2 | 3/2006 | Collie et al. |
| 7,600,571 | B2 | 10/2009 | Smith |
| 7,654,329 | B2 | 2/2010 | Lindland et al. |

(Continued)

FOREIGN PATENT DOCUMENTS

| | | | |
|---|---|---|---|
| CN | 201486503 | U | 5/2010 |
| CN | 104989314 | A | 10/2015 |

(Continued)

OTHER PUBLICATIONS

Search Report dated Jan. 17, 2017 (3 pages) from corresponding Great Britain Application No. GB 1619855.8.

(Continued)

*Primary Examiner* — Yong-Suk (Philip) Ro
(74) *Attorney, Agent, or Firm* — Brinks Gilson & Lione; John C. Freeman

(57) ABSTRACT

A cap for a hydrocarbon production well, the cap having a body with a top and a bottom. The bottom having a first connecting flange with a first seal face. The first connecting flange configured to connect to an end flange of a wellhead component and the top having a second connecting flange with a second seal face.

18 Claims, 7 Drawing Sheets

(56) References Cited

U.S. PATENT DOCUMENTS

| | | | | |
|---|---|---|---|---|
| 7,992,633 | B2 | 8/2011 | Donald et al. | |
| 7,992,643 | B2 | 8/2011 | Donald et al. | |
| 8,066,067 | B2 | 11/2011 | Donald et al. | |
| 8,091,630 | B2 | 1/2012 | Donald et al. | |
| 8,122,948 | B2 | 2/2012 | Donald et al. | |
| 8,167,049 | B2 | 5/2012 | Donald et al. | |
| 8,220,535 | B2 | 7/2012 | Donald et al. | |
| 8,272,435 | B2 | 9/2012 | Donald et al. | |
| 8,281,864 | B2 | 10/2012 | Donald et al. | |
| 8,469,086 | B2 | 6/2013 | Donald et al. | |
| 8,540,018 | B2 | 9/2013 | Donald et al. | |
| 8,573,306 | B2 | 11/2013 | Donald et al. | |
| 8,622,138 | B2 | 1/2014 | Donald et al. | |
| 8,733,436 | B2 | 5/2014 | Donald et al. | |
| 8,746,332 | B2 | 6/2014 | Donald et al. | |
| 9,556,710 | B2 | 1/2017 | Donald et al. | |
| 10,107,069 | B2 | 10/2018 | Donald et al. | |
| 2004/0074635 | A1 | 4/2004 | Collie et al. | |
| 2006/0185841 | A1* | 8/2006 | Swagerty | E21B 33/068 166/88.1 |
| 2006/0237194 | A1 | 10/2006 | Donald et al. | |
| 2008/0289817 | A1 | 11/2008 | Smith | |
| 2009/0294125 | A1 | 12/2009 | Donald et al. | |
| 2009/0294132 | A1 | 12/2009 | Donald et al. | |
| 2009/0301727 | A1 | 12/2009 | Donald et al. | |
| 2009/0301728 | A1 | 12/2009 | Donald et al. | |
| 2010/0206546 | A1 | 8/2010 | Donald et al. | |
| 2010/0206547 | A1 | 8/2010 | Donald et al. | |
| 2010/0206576 | A1 | 8/2010 | Donald et al. | |
| 2011/0108275 | A1* | 5/2011 | Borak | E21B 17/1007 166/308.1 |
| 2011/0226483 | A1 | 9/2011 | Donald et al. | |
| 2011/0253380 | A1 | 10/2011 | Donald et al. | |
| 2011/0290500 | A1 | 12/2011 | Donald et al. | |
| 2011/0304138 | A1 | 12/2011 | Commoner | |
| 2012/0046850 | A1 | 4/2012 | Botich | |
| 2012/0160507 | A1 | 6/2012 | Donald et al. | |
| 2012/0175103 | A1 | 7/2012 | Donald et al. | |
| 2012/0267094 | A1 | 10/2012 | Donald et al. | |
| 2013/0161020 | A1 | 6/2013 | Donald et al. | |
| 2013/0306325 | A1 | 11/2013 | Shaw | |
| 2014/0238687 | A1 | 8/2014 | Donald et al. | |
| 2014/0332226 | A1 | 11/2014 | Donald et al. | |
| 2017/0138146 | A1 | 5/2017 | Donald et al. | |

FOREIGN PATENT DOCUMENTS

| | | | |
|---|---|---|---|
| WO | WO 01/81710 | A1 | 11/2001 |
| WO | WO 2005/047646 | A1 | 5/2005 |

OTHER PUBLICATIONS

International Search Report (2 pages) dated Dec. 18, 2017 from corresponding PCT Application PCT/EP2017/079025.

International Preliminary Examination Report (6 pages) dated May 28, 2019 from corresponding PCT Application PCT/EP2017/079025.

* cited by examiner

CAP FOR A HYDROCARBON PRODUCTION WELL AND METHOD OF USE

RELATED APPLICATIONS

This application claims the benefit under 35 U.S.C. § 371 of the filing date of International Patent Application No. PCT/EP2017/079025, having an international filing date of Nov. 13, 2017, which claims priority to Great Britain Application No. 1619855.8, filed Nov. 24, 2016, the contents of both of which are incorporated herein by reference in their entirety.

The present invention relates to a cap for use with a hydrocarbon production well, for example a cap for use on a wellhead or a valve tree.

BACKGROUND

The present disclosure relates to methods and equipment for petroleum exploration and exploitation. Prior art useful to give a general understanding of the field of technology includes CN 104989314 A, U.S. Pat. Nos. 5,107,931, 7,654,329 and US 2013/306325. U.S. Pat. No. 7,600,571 describes a method and apparatus for re-entering an abandoned well having a production plate arranged to seal a production casing.

In petroleum production, there is commonly a need to temporarily abandon a well, i.e. shut down and stop production from the well for a certain period of time. This period can be anything from a few days, to months or even several years. As opposed to a permanent abandonment of the well, where the wellhead is removed and the casings cut below the mudline, the operator will have an option of re-entering the well at a future time. In a temporary abandonment, permanent measures, such as removing the well casing and wellhead, will therefore not be carried out.

Such temporary abandonment is commonly carried out by setting cement plugs downhole, and arranging a temporary abandonment cap and/or a valve arrangement on the wellhead or the valve tree (Xmas/Christmas tree). One can thereby re-enter the well, for example in order to repair if leaks should occur.

It is of great importance that such temporary abandonment equipment and methods provide a safe and reliable solution, for example to minimize the risk of leakage from the well. Moreover, it is desirable that temporary abandonment can be carried out in a low-cost and effective manner, with low maintenance needs.

In other instances, there may be a need to enter the well and/or gain access to a valve tree independently of a temporary abandonment, for example in case some or all of the actuated valves have failed in a producing well.

The present invention has the objective to provide equipment and methods to meet at least one of the above mentioned requirements, while providing improvements and/or alternatives to known solutions and techniques.

SUMMARY

In an embodiment, there is provided a cap for a hydrocarbon production well, said cap having a body with a top and a bottom, the bottom having a first connecting flange with a first seal face, the first connecting flange configured to connect to an end flange of a wellhead component, the top having a second connecting flange with a second seal face.

The cap may further comprise a packing seal arranged on the first connecting flange.

The cap may further comprise a recess extending from said first connecting flange into said body.

The cap may further comprise a channel extending between an outside of the cap and the recess.

The cap may further comprise a sensor device arranged in fluid communication with the channel.

The cap may further comprise a cover arranged on the second connecting flange, the cover arranged to cover the second seal face.

The cover may comprise at least one packing seal arranged in sealing engagement with the second connecting flange.

The first connecting flange, the second connecting flange and the body may be machined from a single piece of metal material.

In an embodiment, there is provided a wellhead component having a cap, the wellhead component being a valve tree or a wellhead.

In an embodiment, there is provided a method for entering a hydrocarbon production well, comprising the steps:

providing a wellhead component having a cap according to any of the embodiments described above, the wellhead component being a valve tree or a wellhead, connecting a riser to the second connecting flange of said cap in sealing engagement with the second seal face, lowering a machining tool into the riser and machining a through-going opening through the body of said cap.

In an embodiment, the well has a downhole plug, and the method comprises the further step of removing or replacing said downhole plug.

In an embodiment, the method further comprises the step of placing a downhole plug in the well.

In an embodiment, the method further comprises the step of machining through at least one valve in the valve tree.

In an embodiment, the step of machining an opening through the body comprises at least one of the steps: milling an opening through the body, and drilling an opening through the body.

In an embodiment, the method further comprises the step of machining through a sensor device and/or a component for a sensor device connected to the body.

In an embodiment, there is provided a method for enabling re-entry into a hydrocarbon production well, comprising the steps: providing a cap according to any of the embodiments described above, and arranging the cap on a wellhead component of the well.

In an embodiment, the method further comprises the step of plugging the well by setting at least one plug in the well.

In an embodiment, the wellhead component is a valve tree, or the wellhead component is a wellhead.

BRIEF DESCRIPTION OF THE DRAWINGS

Examples of embodiments of the present invention will now be described with reference to the appended drawings, in which.

DETAILED DESCRIPTION

Figure 1:
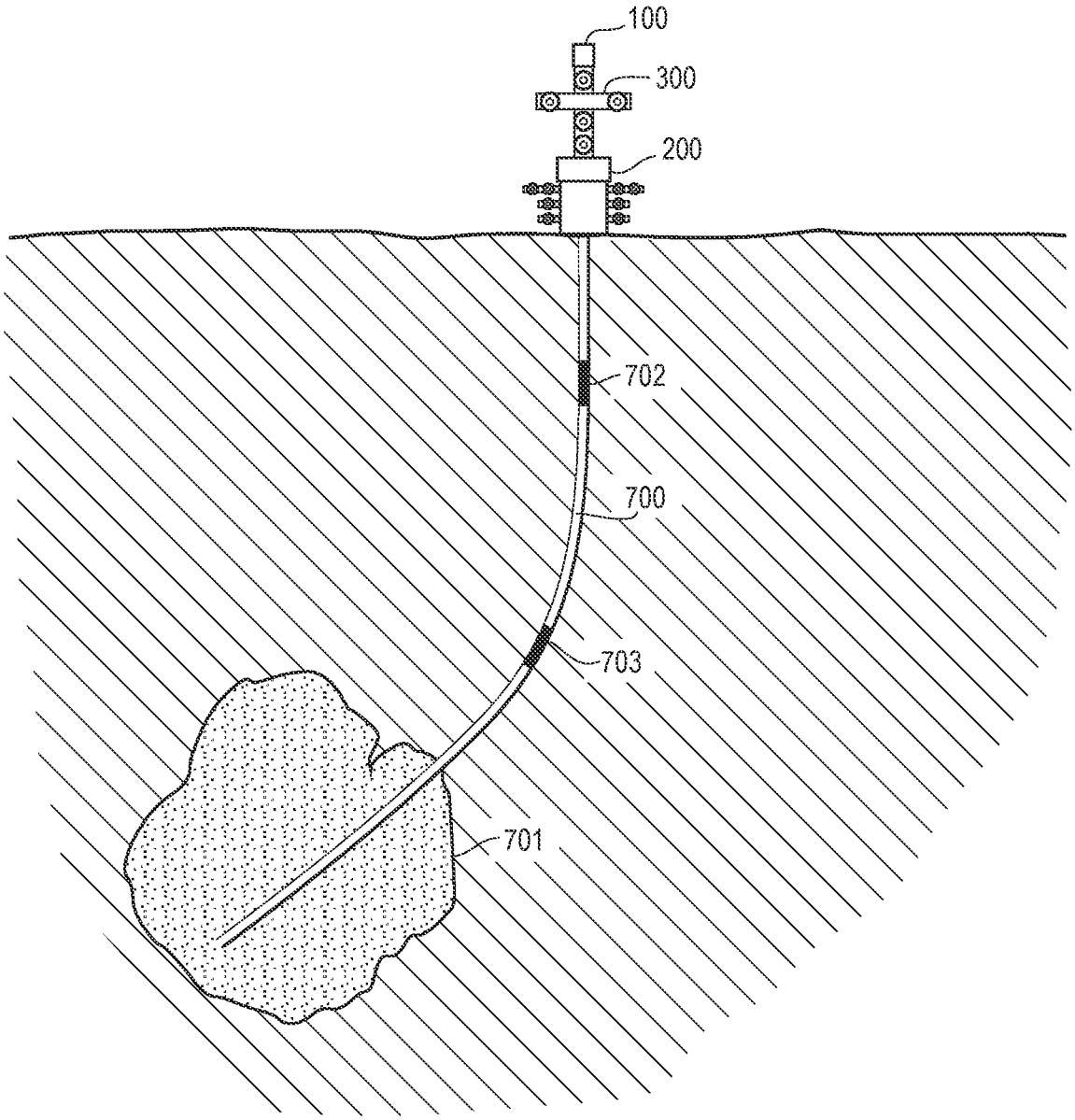
FIG. 1 illustrates a petroleum well extending from a reservoir to a wellhead.
Figure 2A:
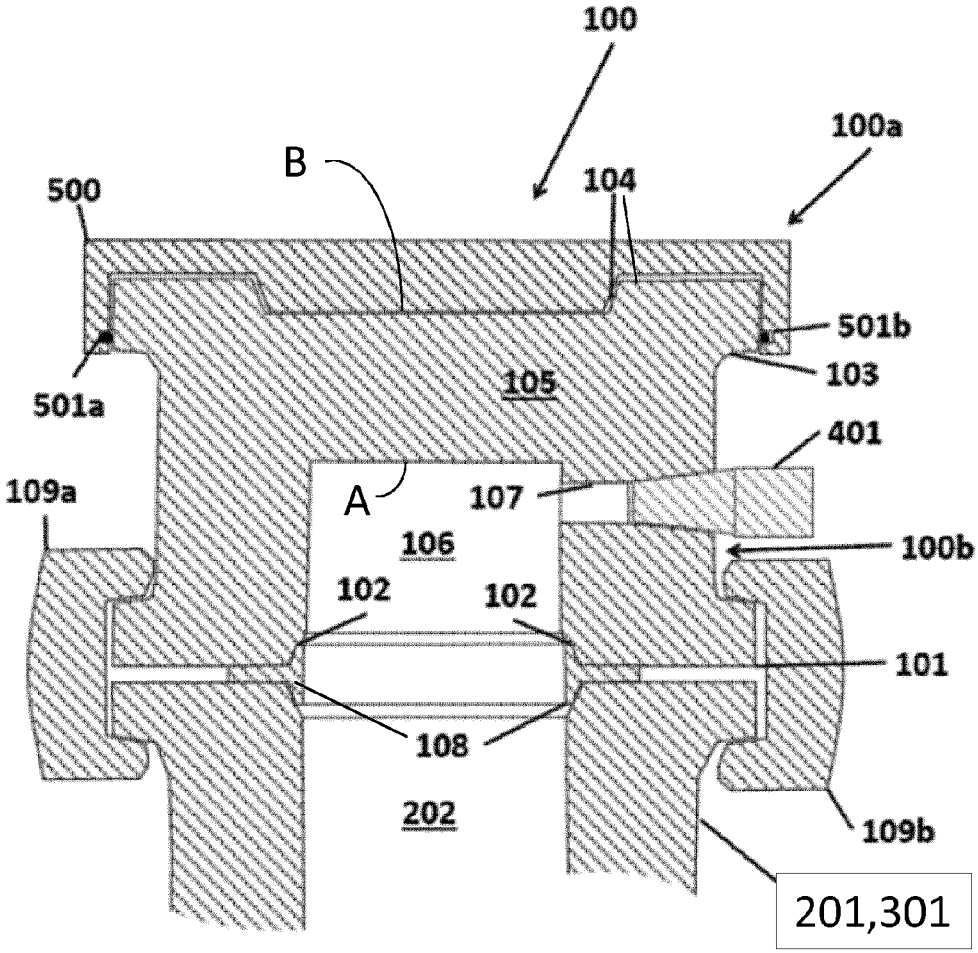
FIGS. 2A-D illustrate a cap according to an embodiment, in cross-sectional, bottom and top views.
Figure 2B:
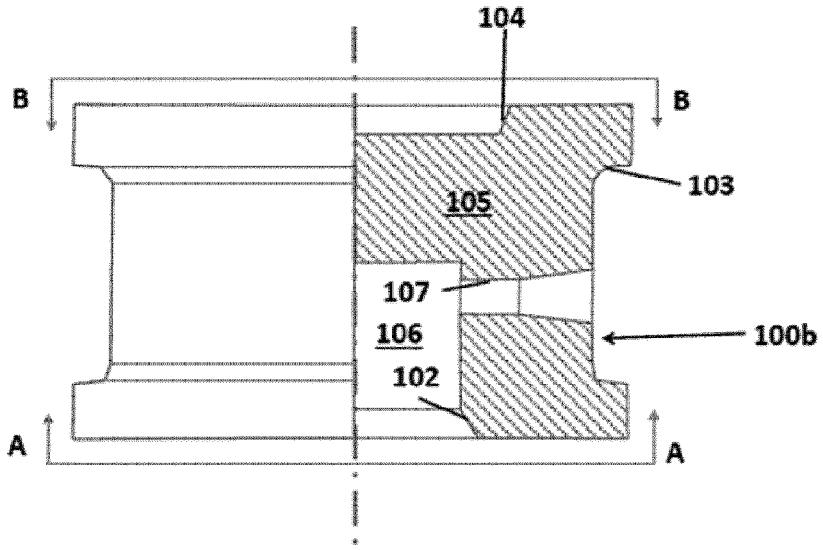
Figure 2C:
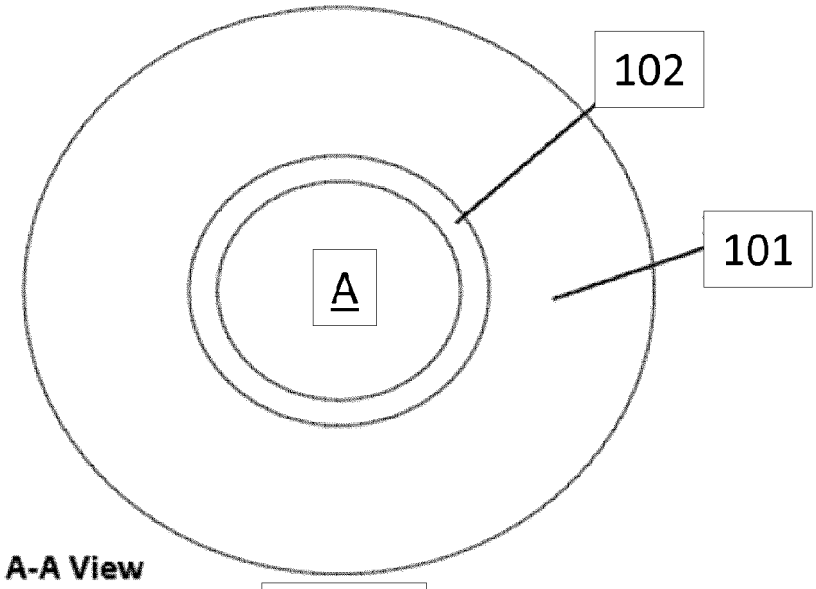
Figure 2D:
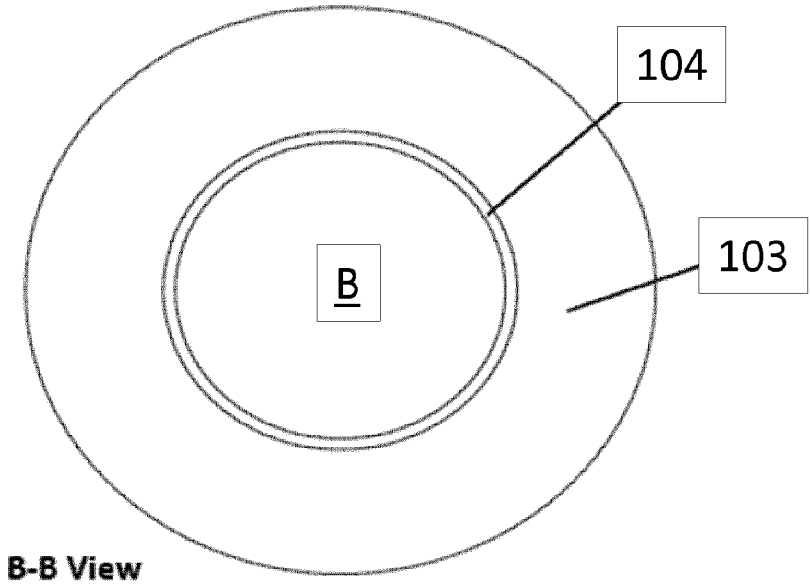

In an embodiment, there is provided a cap 100 for a hydrocarbon production well. FIG. 1 illustrates schematically a well 700 extending from a subterranean reservoir 701 to a wellhead 200 in the conventional manner. A valve tree 300 (commonly known as a Xmas tree) is arranged on the wellhead 200. The cap 100 may be arranged on a top flange of the valve tree. Alternatively, the cap 100 may be arranged on the wellhead 200. These alternatives will be described in further detail below. The well 700 illustrated in FIG. 1 has a surface wellhead 200, however the disclosure herein is not limited to any particular type of well and the wellhead may equally well be, for example, a subsea wellhead. In certain embodiments, the well 700 may have downhole plugs 702, 703 arranged therein, or such plugs may be placed into the well 700. This will be described in further detail below.

The cap 100 is illustrated in further detail in FIGS. 2A-D. The cap 100 has a top 100*a* and a bottom 100*b*. The bottom 100*b* of the cap 100 has a first connecting flange 101 with an annular first seal face 102 which encloses a surface area A of the cap 100 at the bottom 100*b*, in this embodiment a circular area A, having a size which is substantially similar to or slightly larger than the cross-sectional area of the top of the wellhead bore with which the cap 100 is intended to be used. The top 100*a* of the cap 100 has a second connecting flange 103 with an annular second seal face 104 which encloses a surface area B of the cap 100 at the top 100*a*. The body 105 is arranged/plugged such that no fluid communication is possible between the area A enclosed by the first seal face 102 and the area B enclosed by the second seal face 104.

The seal faces 102 and 104 are parts of the flanges 101 and 103 and are prepared, machined and/or treated such as to provide sufficient sealing properties against packing seals 108 and 602 (see e.g. FIG. 5B), for example in relation to their surface roughness properties and geometry.

The first flange 101 is configured to connect to an upper end flange 201, 301 of a wellhead component. The wellhead component may be the wellhead 200 itself (see FIG. 3A), a valve tree 300 (see FIG. 4A), also known as a Christmas tree, or any other intermediate component arranged with the wellhead 200 and having a through bore in communication with the well. When connected, the area A will overlap at least partly with a through bore 202 of the wellhead 200 or, alternatively, with a through bore of the valve tree 300.

Figures 5A, 5B, 5C:
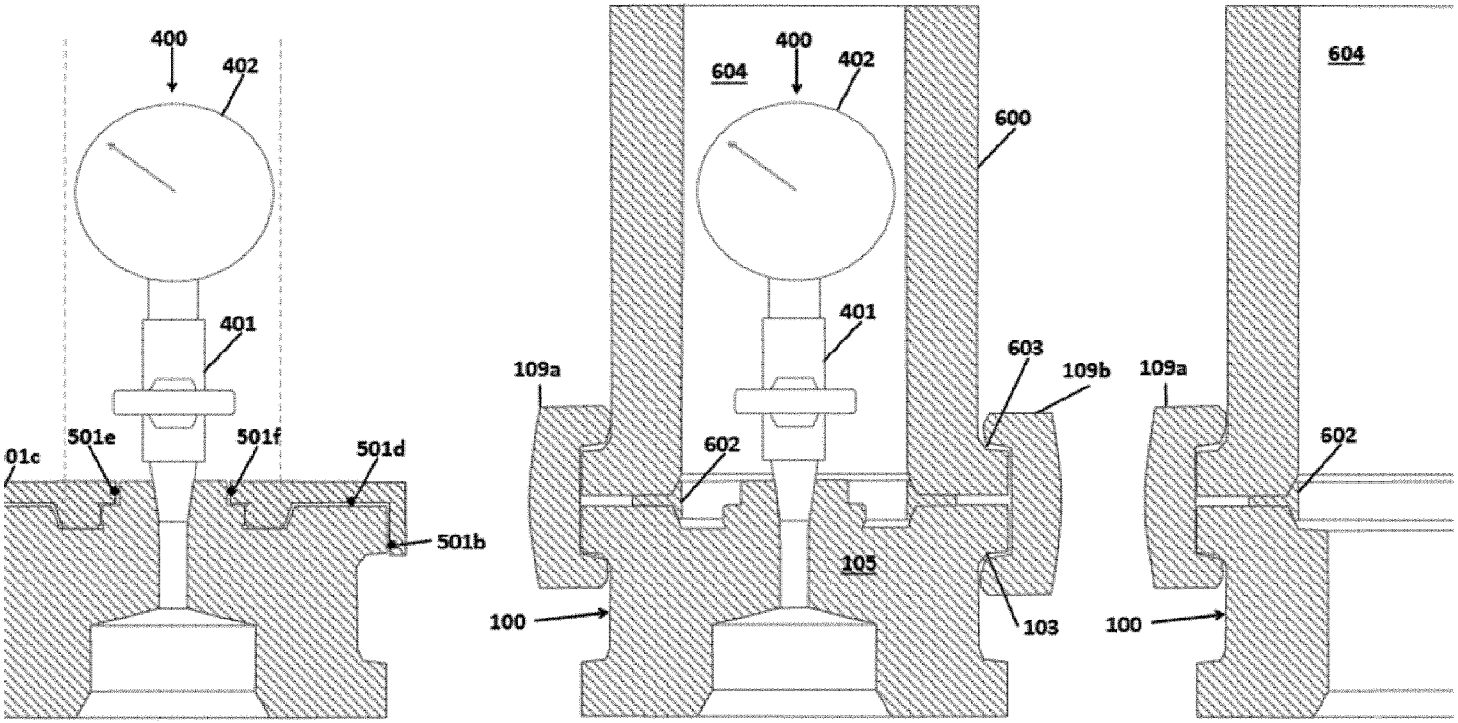
FIGS. 5A-C illustrate details of a cap and its connection to a riser.
Figure 6C:
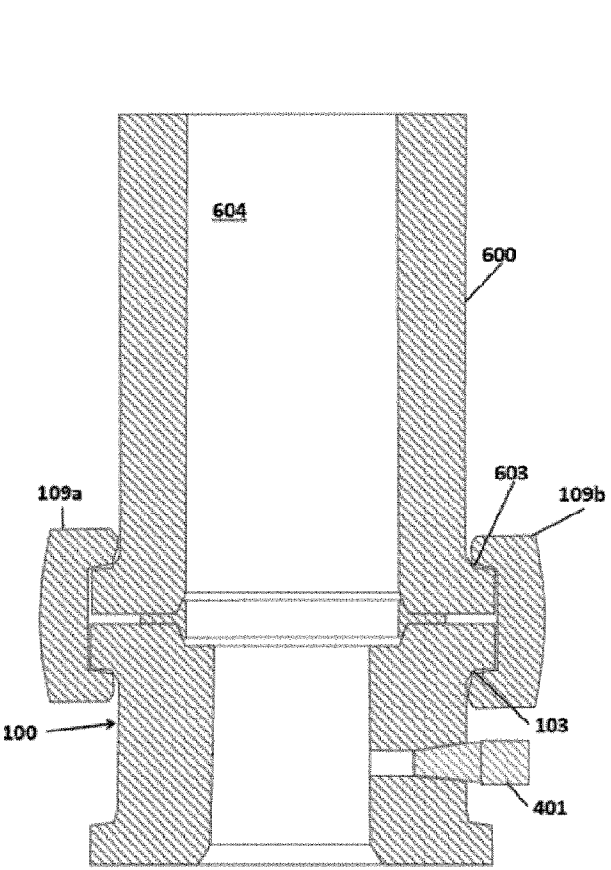
FIGS. 6A-C illustrate details of a cap and its connection to a riser.
Figure 6B:
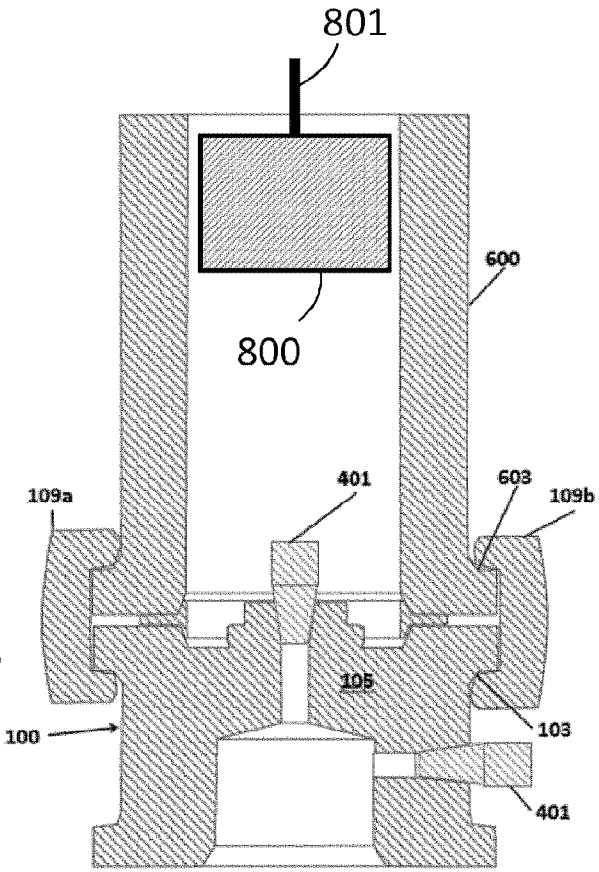
Figure 6A:
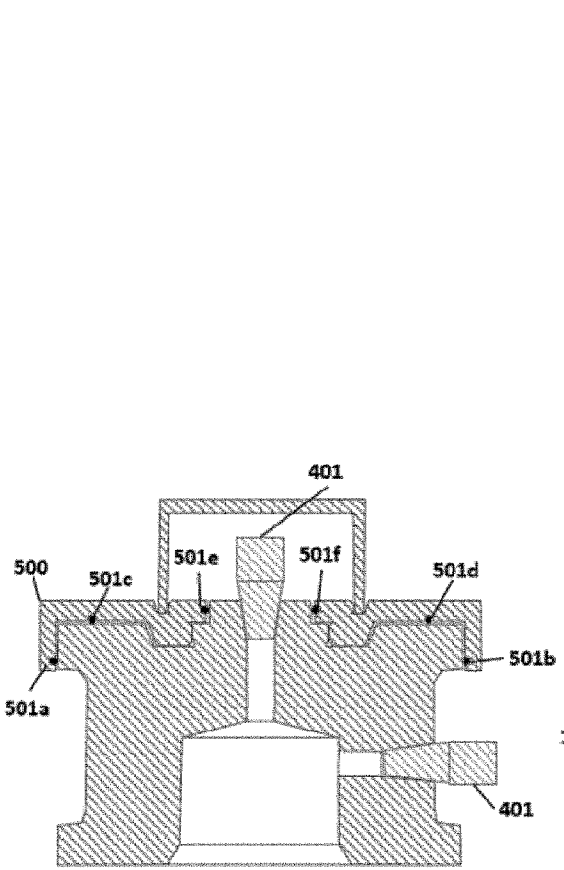

The cap 100 in this embodiment comprises a recess 106 with a bottom having the aforementioned area A. The recess 106 extends into the body 105 from the bottom 100*b* of the cap 100. A channel 107 extends from the recess 106 to an outside of the cap 100. The channel 107 may extend to the outside of the cap 100 through the side of the cap 100, as shown in FIG. 1, or through the body 105 and via the top 100*a*, as shown in e.g. FIGS. 5A and 6A. Alternatively, more than one channel may extend to the outside of the cap 100, as shown in FIGS. 6A and 6B.

A sensor device 400, for example a pressure sensor, may be arranged in the channel 107 or in fluid communication with the channel 107. In this embodiment, a pressure gauge base 401 is arranged in the channel 107 with a pressure gauge 402 optionally connectable to the base 401. The pressure gauge base 401 blocks the channel 107 to prevent any fluid flowing through it, and allows the pressure gauge 402 to be connected for monitoring of the pressure in the recess 106.

A cap cover 500 can be arranged on the second connecting flange 103 and arranged to cover or protect the second seal face 104. The cap cover 500 may be arranged to seal against the second connecting flange 103 by means of one or more packing seals 501*a-f* (see also FIGS. 5A and 6A). The cap cover 500 may, for example, be made from Teflon™, nylon, or a similar material.

The cap 100, including the first connecting flange 101, the second connecting flange 103 and the body 105 may be machined from a single piece of metal material. This improves structural strength and reduces the risk of leakage etc.

Examples of the use of a cap 100 according to the above described embodiment will now be outlined.

When a well is to be temporarily abandoned, the well will be prepared according to how long the well is intended to remain abandoned. If the well is to be abandoned for longer periods of time, the valve tree 300 and parts or all of the completion equipment (production tubing, non-cemented casings, etc.) are usually removed. The wellhead 200 is, however, not removed. The well is plugged downhole with e.g. cement plugs 702, 703, schematically indicated in FIG. 1, arranged in the wellbore. This will prevent reservoir fluids from flowing to surface. Conventionally, a temporary abandonment cap is arranged on the wellhead in order to provide an additional barrier, and in order to monitor the pressure at the wellhead, and the temporary abandonment cap may have a valve to enable reentry into the well for repairs or further plugging (e.g. for permanent abandonment) of the well at a later time, if required.

Figure 3B:
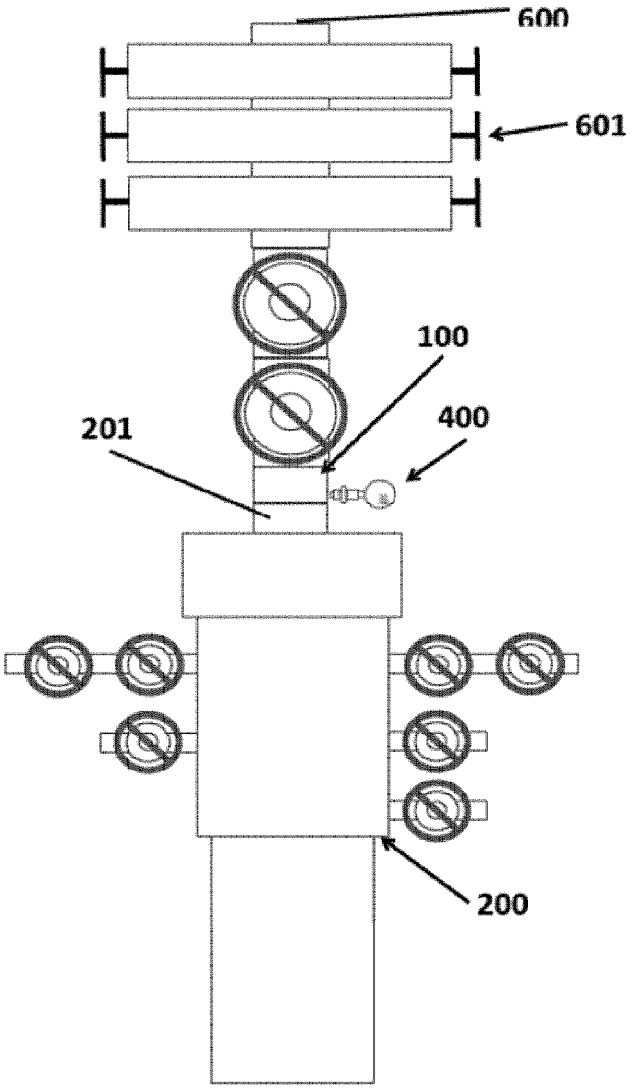
FIGS. 3A and 3B illustrate a wellhead with a cap connected thereto.
Figure 3A:
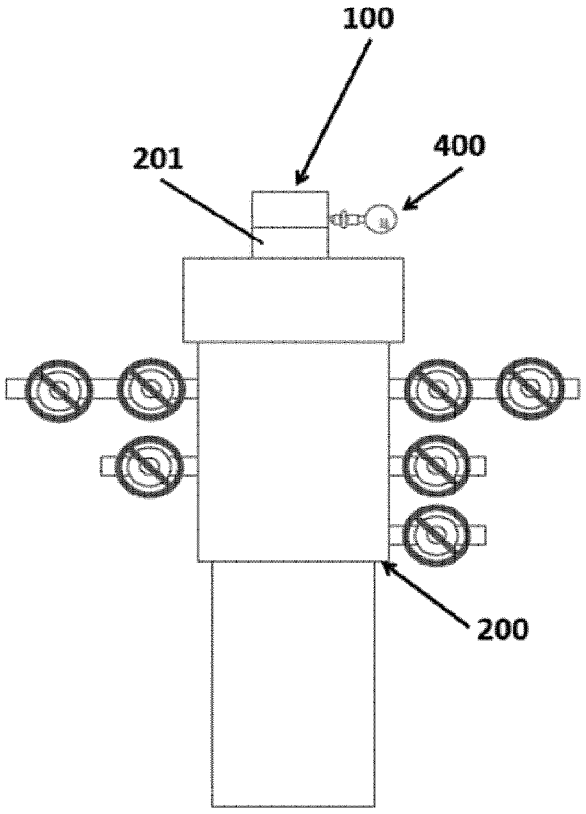

According to one embodiment, when the well has been plugged, a cap 100 according to one of the designs described herein may be placed on the upper flange of the wellhead 200. FIG. 3A illustrates a cap 100 arranged on the upper flange 201 of a wellhead 200. An annular metal-to-metal packing seal 108 (see FIG. 1) is arranged to seal between the upper flange 201 and the first flange 101 of the cap 100. Clamp connectors 109*a,b* are used to secure the connection.

When in place, the cap 100 will seal the outlet of the through bore 202 of the wellhead 200 (or the outlet of the valve tree 300, as the case may be). The shown cap 100 comprises no reentry valve and very few seal faces, and therefore provides a safe and reliable seal for the well which may remain in place for long periods of time with little or no maintenance. If a sensor device 400 is used, such as a pressure sensor, one can monitor the state inside the through bore 202 and thus identify for example potential leakage past the downhole plugs and consequent pressure build-up at the wellhead.

The cap cover 500, if used, will protect the top of the second connecting flange 103, including the seal face 104. The space between the cap cover 500 and the second connecting flange 103 may be grease-filled. Regular maintenance of the temporarily abandoned well may include temporarily removing the cap cover 500 and replacing the grease, to ensure reliable protection of the seal face 104 in order to avoid e.g. corrosion or damage. The cap cover 500 may have a snap connection or the like for this purpose. Optionally, this may include replacing the cap cover 500 itself at regular intervals. The cap cover 500 may be "top-hat"-shaped to cover a gauge base 401 located on the top 100*a*, as illustrated in FIG. 6A.

When re-entry into the well is required, such as for permanent plugging, a riser 600 can be connected to the second flange 103 and brought in sealing engagement with the second seal face 104. The riser 600 may comprise a blowout preventer stack 601 (see FIG. 3B) and/or other relevant pressure control equipment for this operation. FIGS. 5B, 5C, 6B and 6C show further details of the connection between the riser 600 and the cap 100. A metal-to-metal packing seal 602 may be provided between the seal face 104 and a corresponding seal face of the lower flange 603 of the riser 600. Clamp connectors 605 can, for example, be used to secure the connection. When connected, the area B at the top 100*a* of the cap 100 is accessible from the internal bore 604 of the riser 600.

After pressure testing of the connections, milling equipment 800 (see FIG. 6B) is run into the riser 600 to mill out an opening in the body 105 of the cap 100, to create a connection between the riser bore 604 and the through bore 202 of the wellhead 200. When the milling is finished, the well can be intervened through the riser 600 and the opening in the cap 100, and further operations can be carried out, such as replacement of downhole plugs and other operations necessary for permanent plugging or repairs.

The method according to this embodiment may include the further step of removing the riser 600, attaching a production riser (not shown) and commencing production from the well. Alternatively, the method may include the step of setting additional plugs in the well 700 for plugging the well. Such plugs may be cement plugs for permanent abandonment and plugging of the well 700.

The machining tool may be a milling tool, a drilling tool, or any equivalent tool capable of machining an opening in the cap 100.

If a sensor device 400, or any component associated therewith, such as the base 401, is arranged at the top 100*a* of the cap 100, the machining tool 800 may also machine through this device. FIGS. 5A-C show an example of this case. FIG. 5A illustrates the situation during the temporary abandonment, with the cap 100 in place with the cap cover 500 attached. In order to re-enter the well, the cap cover 500 is removed, and a riser 600 connected to the second connecting flange 103. This situation is shown in FIG. 5B. FIG. 5C shows the situation after milling, where part of the body 105 and the sensor device 400 have been machined out. FIGS. 6A-C show the same steps for a system in which the pressure gauge 402 has been removed.

According to some embodiments, the need for a valve in the temporarily abandoned wellhead to enable re-entry is therefore eliminated, since a system and/or method according to embodiments described herein permit such re-entry when required. This saves the cost of the valve and the maintenance required to service it regularly (e.g. every year) until the well is re-entered, or the hydrocarbon production platform is finally decommissioned and torn down, and the well permanently plugged. If required, providing a connection channel 107 on the cap 100 will enable pressure monitoring during the years of waiting on final decommissioning.

Figure 4A:
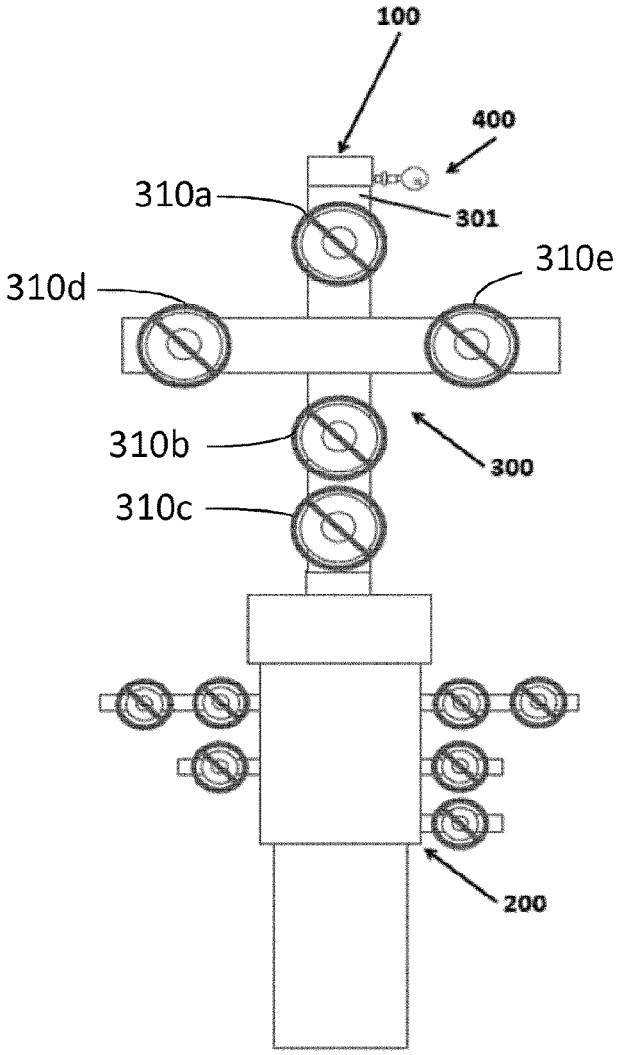
FIGS. 4A and 4B illustrate a wellhead and a valve tree with a cap connected thereto.
Figure 4B:
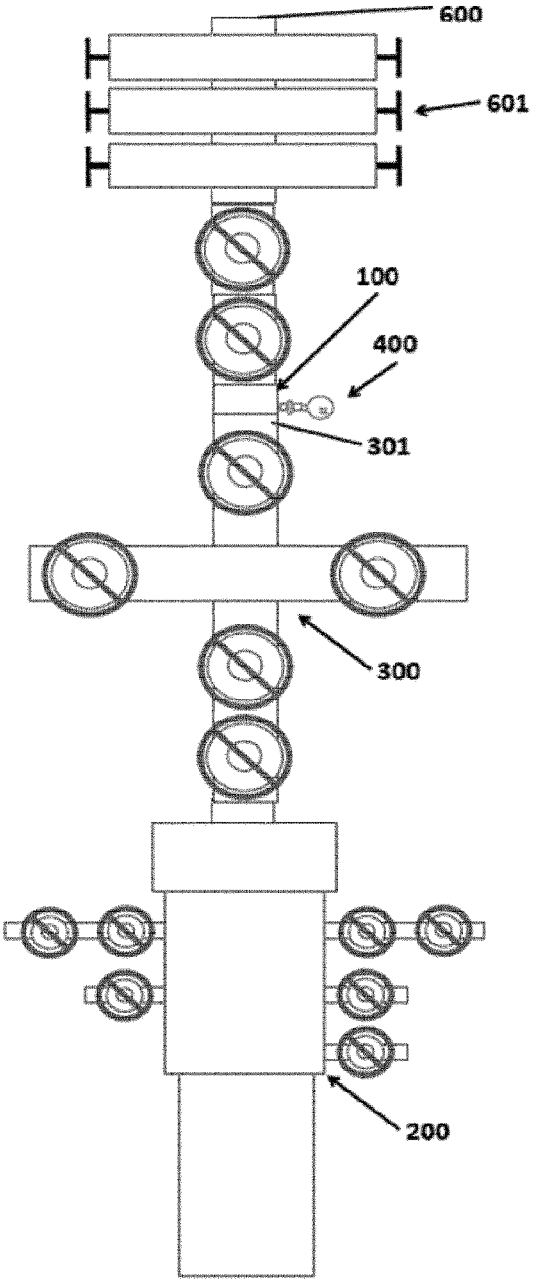

FIGS. 4A and 4B illustrate a situation where the cap 100 is arranged on a valve tree 300. The valve tree 300 has a plurality of valves 310*a-e* and is arranged on a wellhead 200 in the conventional manner. If access is required from above to the vertical through bore of the valve tree 300, access through the cap 100 may be obtained in the equivalent manner as described above. FIG. 4B illustrates this, with a riser 600 having a blowout preventer stack 601 being connected to the second flange 103 of the cap 100, and the machining of an opening through the cap 100 can begin.

The cap 100 can thus, for example, be installed on a valve (Christmas) tree 300 as a contingency device to gain access to the tree in case some or all actuated valves have failed. In this case, the method may also include machining through at least one valve 310*a-c* located in the through bore of the valve tree 300. When the machining is finished and access is gained from the riser 600, through the wellhead through bore 202 and into the well 700, the well can be intervened and secured using e.g. bridge plugs and/or back pressure valves.

The cap 100 can be installed on the valve tree as a permanent feature when the tree is installed or retrofitted as part of normal wellhead maintenance. The cap 100 can, for example, be used in cases where some or all valves 310*a-e* has failed, and where it is not possible to rig up well services equipment on the well. In such a case, the embodiments described herein may provide an alternative to, for example, performing a freezing operation or to kill the well. In mature fields, such a kill operation can be an undesirable option as the fluid level in the well cannot be appropriately monitored. A freeze option can be both complicated and not risk-free.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The present invention is not limited to the embodiments described herein. Reference should be had to the appended claims.

The invention claimed is:

1. A sealing cap for sealing a hydrocarbon production well, the sealing cap comprising:

a body comprising a top and a bottom;

wherein the bottom comprises a first connecting flange comprising a first seal face prepared for sealing against a packing seal, wherein the first connecting flange comprises a structure to connect to an end flange of a wellhead component;

wherein the top comprises a second connecting flange comprising a second seal face prepared for sealing against a packing seal;

a recess extending from the first connecting flange into the body;

a channel extending between an outside of the sealing cap and the recess; and a sensor device arranged in fluid communication with the channel.

2. The sealing cap according to claim 1, the body forming a fluid-tight structure between a first area (A) enclosed by the first seal face and a second area (B) enclosed by the second seal face.

3. The sealing cap according to claim 1, further comprising a packing seal arranged on the first connecting flange.

4. The sealing cap according to claim 1, further comprising a cover arranged on the second connecting flange, the cover arranged to cover the second seal face.

5. The sealing cap according to claim 4, wherein the cover comprises at least one packing seal arranged in sealing engagement with the second connecting flange.

6. The sealing cap according to claim 1, wherein the first connecting flange, the second connecting flange, and the body are machined from a single piece of metal material.

7. A wellhead system comprising:

a wellhead component comprising a valve tree or a wellhead; and a sealing cap connected to the wellhead component and structured to prevent a fluid escaping from the wellhead component, wherein the sealing cap comprises:

a body comprising a top and a bottom;

wherein the bottom comprises a first connecting flange comprising a first seal face prepared for sealing against a packing seal, wherein the first connecting flange comprises a structure to connect to an end flange of the wellhead component;

wherein the top comprises a second connecting flange comprising a second seal face prepared for sealing against a packing seal;

a recess extending from the first connecting flange into the body;

a channel extending between an outside of the sealing cap and the recess; and a sensor device arranged in fluid communication with the channel.

8. A method for entering a hydrocarbon production well, comprising:

providing a wellhead component comprising a valve tree or a wellhead, wherein a sealing cap is connected to the wellhead component wherein the sealing cap comprises:

a body comprising a top and a bottom;

wherein the bottom comprises a first connecting flange comprising a first seal face, wherein the first connecting flange comprises a structure to connect to an end flange of the wellhead component;

wherein the top comprises a second connecting flange comprising a second seal face;

the method further comprising:

connecting a riser to the second connecting flange of the sealing cap in sealing engagement with the second seal face;

lowering a machining tool into the riser and machining a through-going opening through the body of the sealing cap.

9. The method according to claim 8, wherein the hydrocarbon production well comprises a downhole plug, wherein the method further comprises removing or replacing the downhole plug.

10. The method according to claim 8, further comprising placing a downhole plug in the hydrocarbon production well.

11. The method according to claim 8, wherein the wellhead component is the valve tree, wherein the method further comprises machining through at least one valve in the valve tree.

12. The method according to claim 8, wherein the machining an opening through the body comprises: milling an opening through the body and/or drilling an opening through the body.

13. The method according to claim 8, comprising machining through a sensor device.

14. The method according to claim 8, comprising machining through a component for a sensor device connected to the body.

15. A method for enabling re-entry into a hydrocarbon production well, comprising:

providing a sealing cap, wherein the sealing cap comprises:

a body comprising a top and a bottom;

wherein the bottom comprises a first connecting flange comprising a first seal face prepared for sealing against a packing seal, wherein the first connecting flange comprises a structure to connect to an end flange of a wellhead component;

wherein the top comprises a second connecting flange comprising a second seal face prepared for sealing against a packing seal;

a recess extending from the first connecting flange into the body;

a channel extending between an outside of the sealing cap and the recess; and a sensor device arranged in fluid communication with the channel; and arranging the sealing cap on a wellhead component of the hydrocarbon production well.

16. The method according to claim 15, further comprising plugging the hydrocarbon production well by setting at least one plug in the hydrocarbon production well.

17. The method according to claim 16, wherein the wellhead component is a valve tree, or the wellhead component is a wellhead.

18. The method according to claim 15, wherein the wellhead component is a valve tree, or the wellhead component is a wellhead.

* * * * *